US007950072B1

(12) United States Patent
Hanson

(10) Patent No.: US 7,950,072 B1
(45) Date of Patent: May 31, 2011

(54) REVERSIBLE BELT WITH SLIDE BUCKLE

(76) Inventor: Violet Hanson, Old Bethpage, NY (US)

( * ) Notice: Subject to any disclaimer, the term of this patent is extended or adjusted under 35 U.S.C. 154(b) by 1762 days.

(21) Appl. No.: 11/144,490

(22) Filed: Jun. 3, 2005

(51) Int. Cl.
*A41F 3/02* (2006.01)

(52) U.S. Cl. ..... 2/338

(58) Field of Classification Search ..... 2/338, 310–325, 2/326; 24/662, 104, 31 R
See application file for complete search history.

(56) References Cited

U.S. PATENT DOCUMENTS

| | | | | |
|---|---|---|---|---|
| 2,009,325 | A * | 7/1935 | Sachs | 2/301 |
| 3,411,161 | A * | 11/1968 | Meeker | 2/301 |
| 4,118,837 | A | 10/1978 | Hoch | |
| 4,282,634 | A | 8/1981 | Krauss | |
| 4,386,452 | A | 6/1983 | Stephenson | |
| 4,406,043 | A | 9/1983 | Friedman | |
| 4,501,026 | A | 2/1985 | Seneca | |
| 4,703,706 | A | 11/1987 | Plante | |
| 4,761,861 | A | 8/1988 | Peles | |
| 4,843,699 | A | 7/1989 | Ikeda | |
| 5,046,197 | A | 9/1991 | Chernuchin et al. | |
| 5,073,155 | A | 12/1991 | Mabie | |
| 5,138,751 | A | 8/1992 | Shima et al. | |
| 5,158,450 | A | 10/1992 | Horita et al. | |
| 5,193,225 | A | 3/1993 | Karami et al. | |
| 5,491,845 | A | 2/1996 | Takimoto | |
| 5,515,550 | A | 5/1996 | Friedman et al. | |
| 5,548,843 | A | 8/1996 | Chase et al. | |
| 5,590,443 | A | 1/1997 | Fildan | |
| 5,623,735 | A | 4/1997 | Perry | |
| 5,832,569 | A | 11/1998 | Berg | |
| 5,984,886 | A | 11/1999 | Miller | |
| 6,068,606 | A | 5/2000 | Castel et al. | |
| 6,108,821 | A | 8/2000 | Malsoute | |
| 6,113,332 | A | 9/2000 | Hill | |
| 6,125,475 | A | 10/2000 | Taylor | |
| 6,163,890 | A | 12/2000 | Utamaru | |
| 6,327,714 | B1 | 12/2001 | Koerner | |
| 6,348,019 | B1 | 2/2002 | Yuan | |
| 6,361,459 | B1 | 3/2002 | Serkh et al. | |
| 6,389,605 | B2 | 5/2002 | Srivastava | |
| 6,449,815 | B1 | 9/2002 | Spiller | |
| 6,454,291 | B1 | 9/2002 | Hillairet et al. | |
| 6,457,210 | B1 | 10/2002 | Shirai | |
| 6,474,464 | B1 | 11/2002 | Horton et al. | |
| 6,604,262 | B2 | 8/2003 | Wang | |
| 6,658,705 | B2 | 12/2003 | Yoon | |
| 6,665,913 | B2 | 12/2003 | Kosh et al. | |
| 6,694,644 | B2 | 2/2004 | Haupt | |
| 6,735,826 | B2 | 5/2004 | Uehara et al. | |
| 6,748,628 | B2 | 6/2004 | Sauter et al. | |
| 6,766,532 | B1 | 7/2004 | Cabana | |

* cited by examiner

*Primary Examiner* — Tejash Patel
(74) *Attorney, Agent, or Firm* — Bernard S. Hoffman

(57) ABSTRACT

A reversible belt with a slide buckle. One end of the reversible belt is thick enough to prevent the slide buckle from sliding there off so as to be retained thereon without looping the one end of the reversible belt. The other end of the reversible belt is thin enough to allow the slide buckle to slide there off so as to be replaceable on the reversible belt without compromising the structural integrity of the reversible belt, thereby allowing the slide buckle to be slide there off, the reversible belt reversed, and the slide buckle slide back thereon so as to allow the reversible belt to be reversible without looping of the one end of the reversible belt and without compromising the structural integrity of the reversible belt.

10 Claims, 6 Drawing Sheets

REVERSIBLE BELT WITH SLIDE BUCKLE

1. BACKGROUND OF THE INVENTION

A. Field of the Invention.

The present invention relates to a reversible belt having a buckle, and more particularly, the present invention relates to a reversible belt having a slide buckle freely movable there along, retained on one end thereof without looping the one end thereof, and replaceable thereon via the other end thereof without compromising the structural integrity thereof.

B. Description of the Prior Art.

Referring now to the figures, in which like numerals indicate like parts, and particularly to FIGS. 1 and 2, which are, respectively, a diagrammatic perspective view of a typical prior art reversible belt with a buckle, and, a diagrammatic top plan view of the area identified by ARROWS 2-2 in FIG. 1, a prior art reversible belt 20 has a buckle 22.

The prior art reversible belt 20 has a pair of ends 24. One end 26 of the prior art reversible belt 20 is free so as to be able to pass in and out of the buckle 22. The other end 28 of the prior art reversible belt 20 passes through the buckle 22, doubles back onto itself, and is affixed to itself forming a loop 30. The loop 30 of the other end 28 of the prior art reversible belt 20 captures the buckle 22 therein, thereby retaining the buckle 22 on the prior art reversible belt 20.

Numerous innovations for belts, buckles, slides, suspenders, and related devices have been provided in the prior art that will be described infra. Even though these innovations may be suitable for the specific individual purposes to which they address, however, they differ from the present invention in that they do not teach a reversible belt having a slide buckle freely movable there along, retained on one end thereof without looping the one end thereof, and replaceable thereon via the other end thereof without compromising the structural integrity thereof.

(1) U.S. Pat. No. 4,118,837 to Hoch.

For example, U.S. Pat. No. 4,118,837 issued to Hoch on Oct. 10, 1978 teaches a buckle for a belt or the like having two buckle members detachably connectable with each other and each adapted to retain a respective end portion of the belt. Each of the buckle members includes a first portion detachably connectable with a first portion of the other buckle member, and a second portion adapted to confine the end portion of the belt therein. The second portion of the buckle member has at least two sections movable relative to each other between a first position in which the end portion of the belt is firmly retained in the second portion of the buckle member and a second position in which the end portion of the buckle is released so as to be removable from the buckle member. Apparatus is provided for arresting the sections of the second portion in the first position. The apparatus includes a pivotable arresting element operative for urging the sections of the second portion into the first position.

(2) U.S. Pat. No. 4,282,634 to Krauss.

Another example, U.S. Pat. No. 4,282,634 issued to Krauss on Aug. 11, 1981 teaches a buckle particularly for use in conjunction with belts, straps, and the like. The buckle includes two mating parts locking together upon insertion of a male member into a female member. The male member is generally rectangular in shape and has a slotted end suitable for receiving a belt or strap. The body of the male member includes a projecting portion extending at an angle from the plane of the body. The projecting portion is capable of movement about its point of attachment to the body. The female member is generally rectangular and includes a slot therein for receiving the male member. The slot is defined by a pair of opposing surfaces, which the projecting portion can snap behind upon insertion. An opening is provided in the female member to allow the user to apply pressure to the projecting portion and remove the male member therefrom. A lip is provided to prevent the projection from slipping. A second opening is provided in the female member for the insertion of a belt or strap.

(3) U.S. Pat. No. 4,386,452 to Stephenson.

Still another example, U.S. Pat. No. 4,386,452 issued to Stephenson on Jun. 7, 1983 teaches a self-locking adjust tongue plate including a sleeve surrounding a lock bar extending in slots provided on side flanges of the tongue. The sleeve spaces the lock bar from the walls of the slots so as to avoid metal to metal contact, which may adversely affect the lock-up angles of the adjust tongue.

(4) U.S. Pat. No. 4,406,043 to Friedman.

Yet another example, U.S. Pat. No. 4,406,043 issued to Friedman on Sep. 27, 1983 teaches a belt buckle construction having a keeper with a frame and tongue pivotably disposed on the outer end thereof for interengagement with the longitudinally perforated end of a flexible belt strap. The keeper also includes a rearwardly opening sleeve to receive the inner end of the belt strap that may be of the reversible type. The sleeve includes an upwardly opening undercut slot that exposes a surface portion of the inner end of the belt strap. A combination belt loop and belt clamping member is transversely engageable within the slot and includes a projecting portion for engaging and releasably clamping the inner end of the belt within the sleeve of the keeper. The construction enables the belt to be cut to any desired length and/or reversed from one side to the other. The belt loop portion of the clamping member serves to receive and retain the outer end of the belt flat against the underlying end of the belt for a neat appearance.

(5) U.S. Pat. No. 4,501,026 to Seneca.

Still yet another example, U.S. Pat. No. 4,501,026 issued to Seneca on Feb. 26, 1985 teaches central sections of first and second elongated string-like portions connected by a knot. The first portion carries decorative end elements and includes first and second parts adapted to extend in opposite directions from the rear to the front of the pants to encircle the waistband in belt-like fashion. The ends of the first and second parts are tied together. The second portion is adapted to extend downwardly from the knot, between the leg portions of the pants, and upwardly along the front thereof. The second portion includes third and fourth parts adapted to be clipped onto the first and second parts, respectively, at spaced locations along the first portion, on either side of the point where the first and second parts are tied or onto spaced belt loops across the front of the waistband. In a second, embodiment, a fifth string-like part connects the first and second parts with the third and fourth parts.

(6) U.S. Pat. No. 4,703,706 to Plante.

Yet still another example, U.S. Pat. No. 4,703,706 issued to Plante on Nov. 3, 1987 teaches an elastic band feeding and tensioning mechanism and method for the application of an elastic band and having at least a portion thereof tensioned on a fabric piece fed under a stitching needle of a sewing machine. A footplate guide is provided for positioning the elastic band in alignment on a fabric piece. A sewing guide member is adapted for securement to a foot arm of a sewing machine and has a jaw opening for receiving the elastic band. A guide mechanism is provided for guiding the elastic band toward the jaw opening. The elastic band is advanced through the sewing machine by the feeddog of the sewing machine and tension is applied to the band by tension members. The tension members include a drive and idler rolls driven at a band feeding speed slower than the feeddog and a further band stretching roll that instantaneously stitches the band between the drive roll and feeddog. A control circuit activates the tension members to feed a predetermined length of the elastic band in a predetermined stretched condition through the sewing guide member for sewing the stretched elastic band on the fabric piece. A cutting element also cuts the elastic band at a predetermined location.

(7) U.S. Pat. No. 4,761,861 to Peles.

Still yet another example, U.S. Pat. No. 4,761,861 issued to Peles on Aug. 9, 1988 teaches an arrangement for securing a belt against slipping from a holding clamp by forming a loop in the belt and inserting the loop into a slot of a clamp or a device, with a wedge then inserted into the loop. By pulling the free end of the belt, the loop and wedge enter into the slot.

(8) U.S. Pat. No. 4,843,688 to Ikeda.

Yet still another example, U.S. Pat. No. 4,843,688 issued to Ikeda on Jul. 4, 1989 teaches a compact buckle, streamlined in appearance, and including a main body and a stopper piece. The main body includes a pair of side frames and three shafts disposed between the side frames in such a manner as to extend from one side frame to the other. The stopper piece is axially and pivotably supported between the side frames. The stopper piece is provided with a retaining projection having a sloped surface for cooperating with a correspondingly sloped surface of a winding shaft, which is one of the aforenoted three shafts, in order to frictionally engage and entrap a belt portion therebetween, thereby securing the belt portion within the buckle.

(9) U.S. Pat. No. 5,046,197 to Chernuchin et al.

Still yet another example, U.S. Pat. No. 5,046,197 issued to Chernuchin et al. on Sep. 10, 1991 teaches a belt designed to simulate the appearance of an expensive leather belt, and including a belt strap formed exclusively of molded plastic and has its front face and edge substantially uniformly machine finished. A fastener is secured to the belt strap adjacent one end thereof for operatively fastening the one strap end to the other strap end.

(10) U.S. Pat. No. 5,073,155 to Mabie.

Yet still another example, U.S. Pat. No. 5,073,155 issued to Mabie on Dec. 17, 1991 teaches an endless belt formed by a connector and a finite length of hollow tubing or solid tubing with recesses at each end. The connector is characterized by one or more biting edges at each end of the connector. Each biting edge has a larger diameter than the inside diameter of the tubing and is readily flexible away from the direction of insertion of the edge of the tube. The biting edge is formed as a flexible, rough feathered outlying portion of the base at each of the gripping heads. Once the gripping heads are inserted, tension on the tubing causes the feathered edges and adjacent portions of each gripping head to bite into the internal wall of the tubing and form an improved grip therewith.

(11) U.S. Pat. No. 5,138,751 to Shima et al.

Still yet another example, U.S. Pat. No. 5,138,751 issued to Shima et al. on Aug. 18, 1992 teaches a buckle for connecting opposite ends of a belt or the like. The buckle includes a plug member and a socket member releasably engageable therewith. The socket member has a central through-opening for accommodating a locking member and a spring member, and having a plurality of integrally formed strip-like spring elements arranged to provide uniform distribution of pressure over the locking member.

(12) U.S. Pat. No. 5,158,450 to Horita et al.

Yet still another example, U.S. Pat. No. 5,158,450 issued to Horita et al. on Oct. 27, 1992 teaches a buckle assembly for use in fastening opposite ends of a strap, belt, suspender, and the like. The buckle assembly includes a plug member, a socket member engageable therewith, and tension control apparatus adapted to reciprocate the plug member back and forth through the socket member for a predetermined distance in response to tensile forces applied to the straps. Tension adjusting apparatus is further provided to adjust the compressive tension of the tension control apparatus to a desired extent.

(13) U.S. Pat. No. 5,193,225 to Karami et al.

Still yet another example, U.S. Pat. No. 5,193,225 issued to Karami et al. on Mar. 16, 1993 teaches an elastic band including a plurality of spaced elastic members and a pair of flexible sheet materials on opposed sides of the elastic members. The elastic members are secured in a stretched position to each of the flexible sheet materials.

(14) U.S. Pat. No. 5,491,845 to Takimoto.

Yet still another example, U.S. Pat. No. 5,491,845 issued to Takimoto on Feb. 20, 1996 teaches a fashion belt capable of being applied to various kinds of materials and various cross-sectional shapes, and tightened and loosened easily. This fashion belt is formed by a belt body, and a locking member capable of fixing one end portion of the belt body thereto, receiving the other end portion of the belt body so that the tightening length of the belt body can be regulated, and locking and unlocking the second-mentioned end portion thereof in an arbitrary position of insertion thereof.

(15) U.S. Pat. No. 5,515,550 to Friedman et al.

Still yet another example, U.S. Pat. No. 5,515,550 issued to Friedman et al. on May 14, 1996 teaches a reversible apparel belt having a plurality of interconnected links. Each link is formed from two pieces of flexible sheet material fastened together. The outside surface of the first piece of flexible sheet material differs in appearance from the outside surface of the second piece of flexible sheet material. The front face of the belt is formed from the outside surfaces of the first pieces of flexible sheet material and the back face of the belt is formed from the outside surfaces of the second pieces of flexible material so as to provide a reversible belt.

(16) U.S. Pat. No. 5,548,843 to Chase et al.

Yet still another example, U.S. Pat. No. 5,548,843 issued to Chase et al. on Aug. 27, 1996 teaches a back support for a human user including an elastic support belt having first and second free ends, members secured to the support belt for releasably joining the free ends for maintaining the belt in a closed position in which it forms a closed surface adapted to encircle a human user, and structure secured to the support belt for releasably maintaining the belt in an open position in which the support belt free ends are unattached to each other. A related back support garment includes a garment body having a garment front and a garment back defining an inside and an outside of the garment. The garment body is suitably sized for a human wearer. An elastic support belt is disposed inside the garment body and secured thereto. The elastic support belt has first and second free ends and also has structure for releasably joining the free ends for maintaining the support belt in a closed position in which the support belt forms a closed surface adapted to encircle the human wearer.

(17) U.S. Pat. No. 5,590,443 issued to Fildan.

Still yet another example, U.S. Pat. No. 5,590,443 issued to Fildan on Jan. 7, 1997 teaches a nonslip slide or buckle having elongated teeth projecting along edges of openings defined between outer limbs and a central limb and through which straps are looped for lingerie or corsetry, thereby preventing slippage of the buckle relative to the straps or vice versa without allowing snagging of outer garment fabrics.

(18) U.S. Pat. No. 5,623,735 to Perry.

Yet still another example, U.S. Pat. No. 5,623,735 issued to Perry on Apr. 29, 1997 teaches a pair of suspenders being worn to support pants having a belt threaded through a plurality of belt loops. The suspenders contain a pair of straps being worn over the shoulders. A connector is attached at each end of each strap for hooking the suspenders onto the bottom of the belt. Each connector has a side cross-sectional shape of a hook, a front vertical portion defining a plane extending upward from the bottom of the belt to a point above the top of the belt, and a back vertical portion defining a plane extending upward from the bottom of the belt to a point about the top of the belt.

(19) U.S. Pat. No. 5,832,569 to Berg.

Still yet another example, U.S. Pat. No. 5,832,569 issued to Berg on Nov. 10, 1998 teaches a lockable buckle for belts, straps, and the like, and including an exterior housing or shoe accommodating a freely movable locking slide that forms between it and the inside of the shoe a locking area for nipping a belt or the like passing through the buckle. Locking is brought about by way of a manually operated eccenter mechanism engaging the rear end of the slide. The belt is arranged to enter the front of the buckle from below, through an opening in the shoe, and to pass over a rigid, profiled rib at the front end of the slide before entering the locking area under the slide. When the buckle is locked and the belt is under load, the tension in the belt will press this end of the slide against the belt assisting the locking action exercised by the eccenter mechanism. One end of the belt can be secured to the rear end of the shoe by friction by being threaded back and forth through openings in the shoe in such a way that it becomes strictly aligned with the other end of the belt entering the front end of the buckle.

(20) U.S. Pat. No. 5,984,886 to Miller.

Yet still another example, U.S. Pat. No. 5,984,886 issued to Miller on Nov. 16, 1999 teaches a support belt to be worn around the waist of a person including an elongated Multi-layer strip. The elongated multi-layer strip includes a center portion and a pair of ends. The elongated multi-layer strip is sized and shaped so as to encircle the waist of the person, with the center portion positioned against the back of the person and the pair of ends positioned against the front of the person. The pair of ends are releasably fastenable together to secure the support belt around the waist of the person. The center portion of the elongated multi-layer strip is shaped to define an angle of lordosis of approximately 15 degrees in the lumbar spinal region. A pair of inwardly curved sections sized and shaped so as to urge against the iliac crests of the person wearing the support belt are mounted on the multi-layer strip. The multi-layer strip may include a layer of rigid plastic and a pair of layers of a soft compressible plastic.

(21) U.S. Pat. No. 6,068,606 to Castel et al.

Still yet another example, U.S. Pat. No. 6,068,606 issued to Castel et al. on May 30, 2000 teaches a back support brace for supporting the back of a wearer of the brace for preventing injuries and reinforcing proper lifting mechanics during lifting activities including a back panel, a left side panel, and a right side panel. The left and right side panels are secured at opposite ends of the back panel and are wrappable around the waist of a wearer and adjustably securable thereto. Aligned pairs of belt loops are provided on an inner surface of the brace and are adapted to receive a belt for holding up the pants of the wearer of the brace therethrough so as to prevent the brace from being advanced out of a preset position during lifting activities. A lower edge of the brace includes cutout portions generally positioned above the thighs of the wearer such that the lower edge is contoured to conform to the shape of the wearer throughout lifting activities. Elastic insets extend over the cutout portions to increase tension across the back panel.

(22) U.S. Pat. No. 6,108,821 to Malsoute.

Yet still another example, U.S. Pat. No. 6,108,821 issued to Malsoute on Aug. 29, 2000 teaches a trouser belt including a single-piece band with a first and second extremity, a box fixed to the first extremity of the band, a plate mounted so as to slide within the box following the longitudinal direction and able to be linked to the second extremity by way of a buckle pin, at least one serration longitudinally formed on the sliding plate, at least one tappet assembled in co-operation with the box in a longitudinal direction and including a protruding pin, and a helical spring mounted so as to push the tappet in a position to lock the pin in the teeth of the serration. The mutual longitudinal movement of the box and the plate is therefore avoided, while pressure applied to the tappet against the pressure applied by the spring frees the pin from the serration to allow for the mutual longitudinal movement. A single coaxial spring is implemented to at least one of the tappet.

(23) U.S. Pat. No. 6,113,332 to Hill.

Still yet another example, U.S. Pat. No. 6,113,332 issued to Hill on Sep. 5, 2000 teaches an extractable fastener system using a staple configured to secure various pliant, planar, and three-dimensional materials to a substrate. The staple has a retention base including a retention arch for positioning and securing three-dimensional linear retention material to secure pliant materials to the substrate. The staple also includes an integral extraction arch or arches thereon to facilitate access for an extraction tool to facilitate removal of the staple from the work.

(24) U.S. Pat. No. 6,125,475 to Taylor.

Yet still another example, U.S. Pat. No. 6,125,475 issued to Taylor on Oct. 3, 2000 teaches utility suspenders for use by individuals in the construction trades. The suspenders include a pair of padded and stretchable straps for suspension from the shoulders of a user. Clips adapted to firmly grip a tool belt are secured to the front and rear ends of the straps. A load-distributing pad secures the straps together, adjacent their rear ends. A variable length chest strap is slidably positioned on the straps adjacent their front ends and has a quick release buckle for splitting such in half.

(25) U.S. Pat. No. 6,163,890 to Utamaru.

Still yet another example, U.S. Pat. No. 6,163,890 issued to Utamaru on Dec. 26, 2000 teaches suspenders for suspending trousers. The suspenders include straps and hooks generally fixed at ends of the straps. At least one of the hooks has a strap-hold at a first end thereof for engaging at least one of the straps and a hook portion at a second end thereof for engaging at least one loop on the trousers. The strap-hold has a longitudinal axis and the hook portion extends in a direction that is generally parallel to the longitudinal axis of the strap-hold. The hook portion is configured to generally facilitate hooking of the hook portion on the at least one loop on the trousers.

(26) U.S. Pat. No. 6,327,714 to Koerner.

Yet still another example, U.S. Pat. No. 6,327,714 issued to Koerner on Dec. 11, 2001 teaches a clothing assembly including trousers. The trousers have a waist. The waist has a waistband. The waistband has a right side, a left side, a front side, a back side, and a plurality of upper belt loops. Each belt loop among the plurality is fixedly attached to the waistband. Each of a plurality of lower belt loops is fixedly attached to the waistband. A flexible belt is positioned to form a figure eight. The figure eight includes an upper loop, a lower loop, and a crossover. The upper loop of the figure eight extends through the upper belt loops. The lower loop of the figure eight extends through the lower belt loops. The crossover overlies the right side of the waistband.

(27) U.S. Pat. No. 6,348,019 to Yuan.

Still yet another example, U.S. Pat. No. 6,348,019 issued to Yuan on Feb. 19, 2002 teaches a drive ring CVT belt. In a CVT transmission, each variable diameter pulley has a drive ring trained around the sheaves. Each drive ring may include any high modulus material, such as plastic or metal. An endless flexible tensile member or belt is trained between the drive rings. Each drive ring further includes a sleeve being trained around an outer surface of each drive ring. Each sleeve slides in a bushing on its respective drive ring. The belt has a tensile load pressing each of the drive rings together on the sleeves. The relative arrangement of the axis of rotation of each drive ring is maintained by the contact between the sleeves and the drive rings. The effective diameter or radius of each pulley is adjusted by movement of each drive ring in each pulley. Movement of the pulley sheaves causes the axis of rotation of each drive ring to move eccentrically with respect to the axis of rotation of the pulley. As the rings move, the belt moves with the drive rings and remains trained over the drive rings giving a constant bending radius to the belt. The drive rings each may have a surface profile for use with flat belts, synchronous belts, toothed belts, multi-ribbed belts, or V type belts.

(28) U.S. Pat. No. 6,361,459 to Serkh et al.

Yet still another example, U.S. Pat. No. 6,361,459 issued to Serkh et al. on Mar. 26, 2002 teaches a self-contained mechanical belt tensioner producing damping being a function of the applied hubload through the effect of frictional forces derived from the sliding action of mutually opposing wedges. A first wedge or conical piston is contained within a housing. The conical piston cooperates with a second or conical wedge. A surface of the conical wedge slides on the inner surface of the housing. The conical wedge is expandable in a direction normal to the inner surface of the housing. A spring urges the conical wedge into engagement with the conical piston. As the pulley is loaded, as with an impulse load, the piston will move into the conical wedge. This in turn will cause the conical wedge to expand against the inner surface of the housing. The expansion of the conical wedge in the housing will increase the frictional force between the conical wedge and the housing. This will have the effect of damping movements of the conical piston and in turn the pulley. The greater the impulse, the greater the expansion of the conical wedge. This increases the resultant frictional force resisting movement between the conical wedge and the housing. As the load moves toward a minimum, the frictional force is abated to a low level allowing ease of retraction of the piston.

(29) U.S. Pat. No. 6,389,605 to Srivastava.

Still yet another example, U.S. Pat. No. 6,389,605 issued to Srivastava on May 21, 2002 teaches a belt having two ends that can be attached directly to a wearer's clothing instead of the belt closing on itself like a conventional belt. Two fastening apparatus, such as commercially available vest-clips, are attached to the two extremities of a flexible length of belting material. A buckle or other adjusting apparatus may be provided for varying the length of the wrap belt. In use, the wearer first attaches one end of the belt to a selected position on the wearer's article of clothing. The wearer then wraps the belt around the wearer's torso one or more times. Finally, the wearer fastens the other end of the belt to a second selected position on the wearer's clothing. The wearer may adjust the length of the belt before, during, or after wearing the belt.

(30) U.S. Pat. No. 6,449,815 to Spiller.

Yet still another example, U.S. Pat. No. 6,449,815 issued to Spiller on Sep. 17, 2002 teaches an adjustable strap assembly utilizing hook and loop type fasteners as the primary adjustment apparatus, and which can be used on a variety of articles requiring some measure of adjustment to accommodate different users or different utilizations. The adjustable strap assembly includes an elongated web having an outer surface provided with loop-type fasteners and a securing strap member having an undersurface provided with hook type fasteners. The securing strap member is attached to a first end of the elongated web subsequent to the formation of a first looped end and is releasably secured to the elongated web by the contact and engagement of the hook-type with the loop type fasteners. Release of the hook-type fasteners from the loop-type fasteners is facilitated with a key sliding between the hook-type and loop-type fasteners. The adjustable strap assembly may be used alone as an adjustable strap or may be modified for use as an animal collar or animal collar and harness assembly.

(31) U.S. Pat. No. 6,454,291 to Hillairet et al.

Still yet another example, U.S. Pat. No. 6,454,291 issued to Hillairet et al. on Sep. 24, 2002 teaches a ski binding including a stop and a heel piece. Elastic apparatus opposes the release of the stop and the heel piece. The elastic apparatus includes a blade working in buckling mode between two slides corresponding to the stop and the heel piece, respectively. Conventional springs for releasing the stop and the heel piece are therefore replaced by this longitudinally arranged blade.

(32) U.S. Pat. No. 6,457,210 to Shirai et al.

Yet still another example, U.S. Pat. No. 6,457,210 issued to Shirai et al. on Oct. 1, 2002 teaches a band having an engaging projection part at one end and engaging grooves at the other end to adjust the connection in an annular shape. The band is movable forward but not movable backward relative to the other under the condition that the engaging projection part is locked to the engaging recessed part. A pair of hook parts capable of pulling both end parts by fingers of one hand is installed on both end parts. A buckle connected to the band includes a buckle main body having a bottom plate, a roof frame, and side plates for connecting the bottom plate to the roof frame. An operating plate is installed horizontally inside the roof frame and has an engaging claw engageable with the band engaging grooves and a pressing part.

(33) U.S. Pat. No. 6,474,464 to Horton et al.

Still yet another example, U.S. Pat. No. 6,474,464 issued to Horton et al. on Nov. 5, 2002 teaches a modular conveyor belt constructed of a series of rows of belt modules hingedly interlined by tapered oblong hinge pins and suitable for following straight or curved conveyor paths. Aligned slots formed in one set of hinge elements between successive rows are elongated in the direction of belt travel to allow the belt to fan out in turns. Fan-shaped apertures formed in interleaved hinge elements of an adjacent row and aligned axially with the slots to admit a hinge pin allow the belt to pivot at the hinge to articulate about a sprocket or idler or to enter and exit an incline. The oblong hinge pin has a first region at a first end with a constant long axis to share the belt load among hinge elements encompassing the first region on straight runs. A second region of the hinge pin at an opposite second end has a tapered oblong cross section, the long axis of which increases with distance from the second end to define a variable pitch and to spread the belt tension among the hinge elements at the outside of a turn encompassing the second region. Each belt row can be constructed of individual links stacked together on a support element and retained by fasteners or of integrally molded modules, each including a transverse connecting member from which leading and trailing hinge elements extend. Accessory attachments, such as teeth or side guards, can be added to the belt. The belt can be driven by a cog, a roller chain, or other driving apparatus driving lugs extending from the bottom of the belt. The drive surfaces of the lugs can be obliquely arranged for better load sharing.

(34) U.S. Pat. No. 6,604,262 to Wang.

Yet still another example, U.S. Pat. No. 6,604,262 issued to Wang on Aug. 12, 2003 teaches a method for 3-D engagement of a fastener, in which fastener teeth of two fastener strips received in different height-level within a slider can be engaged together in the same plan by the siding action of the slider. A separate-type fastener enabling 3-D engagement includes first and second fastener strip, each of which has a plurality of equidistant fastener teeth alternately arranged on each of two opposed long substrates, respectively, so that a plurality of projecting portions and recesses with corresponding shape, which can engage with the recesses and projecting portions of opposite strip, are formed on the side edge walls of fastener teeth on each of first and second fastener strips, respectively. The slider has front and rear ends. Inlet ports at high-level and low-level are formed, respectively, at different heights of the front end of the slider. These inlet ports extend along a central plan at the rear end of the slider and merge at this common central plan. A common outlet port is formed at the rear end of the slider. After one end of each of the first and second strips is past, respectively, through the inlet port at high-level and low-level, fastener teeth on each of the first and second fastener strips passing through the outlet port can be meshed on the same plan by the sliding action of the slider.

(35) U.S. Pat. No. 6,658,705 to Yoon.

Still yet another example, U.S. Pat. No. 6,658,705 issued to Yoon on Dec. 9, 2003 teaches an exchangeable self-adjusting device for use in a belt, in which a strap is properly extended due to a slight abdominal motion, and a wearer can easily exchange the buckle to follow the fashion. The device includes a cover being movable left and right, a slidable body inserted into a bottom of the cover, and a bottom plate hinged to one portion of a bottom of the body by way of a hinge. The cover includes a cover hook formed at a front thereof and inserted into a buckle hook provided at a rear of a buckle and a leaf-spring hooking boss with a hooked groove formed at its center. The body includes detachable bosses protruded from both sides thereof, a roller fixing shaft formed at a center of a bottom thereof for rotatably fixing a roller, and a hinge protruded from both sides of the rear thereof towards the bottom and having a hinge hole. The bottom plate includes a detachable portion detachably engaged to the detachable bosses of the body, a strip biting projection formed in a spike shape for biting the strap and extended integral with a hinge boss of the bottom plate, and the hinged bosses protruded from both sides of the strip biting projection and inserted into the hinge hole of the body. The leaf-spring is wound many times around the roller and includes a leaf-spring hook with its end bent in a U-shape to be inserted and secured to a hooked groove of the leaf-spring hooking boss.

(36) U.S. Pat. No. 6,665,913 to Kosh et al.

Yet still another example, U.S. Pat. No. 6,665,913 issued to Kosh et al. on Dec. 23, 2003 teaches an end-fitting buckle having a cam cover allowing webbing to be inserted when the cam cover is in an up position. After inserted, a free end of the webbing is pulled to tighten the webbing while the cover is in an intermediate position. The cover may then be closed to lock both the free end and load end. When the cover is locked, movement of the load end is prevented by teeth in the cam cover. The teeth lock the free end into place, holding the set position of the webbing. The cover design also promotes use of varied thicknesses of webbing because the cam action of the cover utilizes friction between the two ends of the webbing instead of a pinching action.

(37) U.S. Pat. No. 6,694,644 to Haupt.

Still yet another example, U.S. Pat. No. 6,694,644 issued to Haupt on Feb. 24, 2004 teaches a device for clamping together two parts of a sports article including a rectilinear notched tongue integral with a first part of the sports article, a guide integral with the second part of the sports article, the guide having two walls between which the tongue is able to slide, a pawl articulated on the guide and capable of interacting with the notched tongue in order to immobilize it in position relative to the guide, characterized in that it also includes a complementary piece interacting with at least one part of the outer faces of the guide, and of which the portion located on the side with the opening of the guide via which the tongue is inserted includes two divergent walls flaring out and extend beyond the opening of the guide.

(38) U.S. Pat. No. 6,735,826 to Uehara et al.

Yet still another example, U.S. Pat. No. 6,735,826 issued to Uehara et al. on May 18, 2004 teaches a buckle including a buckle main body and an engagement member. The buckle main body includes a base part, at least two insertion holes are provided on the base part with a space in between to which a belt is inserted, and an upstanding piece provided therebetween for bending the belt in a direction away from the base part. The engagement member can be moved to a first position where the buckle can be moved against the belt and to a second position where the buckle can be fixed to the belt. Further, the engagement member includes a pressurizing part for pressurizing the belt in the second position so as to obtain a further bent state and an adjustor capable of adjusting the length of the other belt.

(39) U.S. Pat. No. 6,748,628 to Sauter et al.

Still yet another example, U.S. Pat. No. 6,748,628 issued to Sauter et al. on Jun. 15, 2004 teaches a drive belt assembly for a revolving flat card including a flexible belt. At least a pair of connecting elements are integrally formed with the belt. The connecting elements include a cross-beam with an inclined surface. A locking element is disposed between the pair of connecting elements in order to prevent the connecting elements from approaching one another. The locking element is removable from the pair of connecting elements to allow for the approaching of the connecting elements to one another.

(40) U.S. Pat. No. 6,766,532 to Cabana.

Yet still another example, U.S. Pat. No. 6,766,532 issued to Cabana on Jul. 27, 2004 teaches a back support belt brace system including a back panel, two side panels, two side wings, and a belt. The side wings are attached anywhere along the back panel and the side panels use a hook and loop fastener to provide adjustability. The belt is connected to the back panel, the side panels, and the two side wings with a hook and loop fastener. The belt contains an end with a belt buckle and an end with a plurality of holes, which are interlocked to secure the brace. An adjustable suspension system is attached to the support brace using clips. The suspension system contains adjustable suspenders, shoulder padding, and upper back padding. The back support belt brace system is worn around the waist and the lumbar region of a wearer. The suspension system is worn around the chest and upper back of a wearer similar to a vest.

It is apparent that numerous innovations for belts, buckles, slides, suspenders, and related devices have been provided in the prior art that are adapted to be used. Furthermore, even though these innovations may be suitable for the specific individual purposes to which they address, however, they would not be suitable for the purposes of the present invention as heretofore described, namely, a reversible belt having a slide buckle freely movable there along, retained on an end thereof without looping the end thereof, and replaceable thereon via the other end thereof without compromising the structural integrity thereof.

2. SUMMARY OF THE INVENTION

Accordingly, an object of the present invention is to provide a reversible belt having a slide buckle freely movable there along, retained on one end thereof without looping the one end thereof, and replaceable thereon via the other end thereof without compromising the structural integrity thereof avoiding the disadvantages of the prior art.

Briefly stated, another object of the present invention is to provide a reversible belt with a slide buckle. One end of the reversible belt is thick enough to prevent the slide buckle from sliding there off so as to be retained thereon without looping the one end of the reversible belt. The other end of the reversible belt is thin enough to allow the slide buckle to slide there off so as to be replaceable on the reversible belt without compromising the structural integrity of the reversible belt, thereby allowing the slide buckle to be slide there off, the reversible belt reversed, and the slide buckle slide back thereon so as to allow the reversible belt to be reversible without looping of the one end of the reversible belt and without compromising the structural integrity of the reversible belt.

The novel features that are considered characteristic of the present invention are set forth in the appended claims. The invention itself, however, both as to its construction and its method of operation together with additional objects and advantages thereof will be best understood from the following description when read and understood in connection with the accompanying drawing.

3. BRIEF DESCRIPTION OF THE DRAWING

The figures of the drawing are briefly described as follows.

Figure 9A:
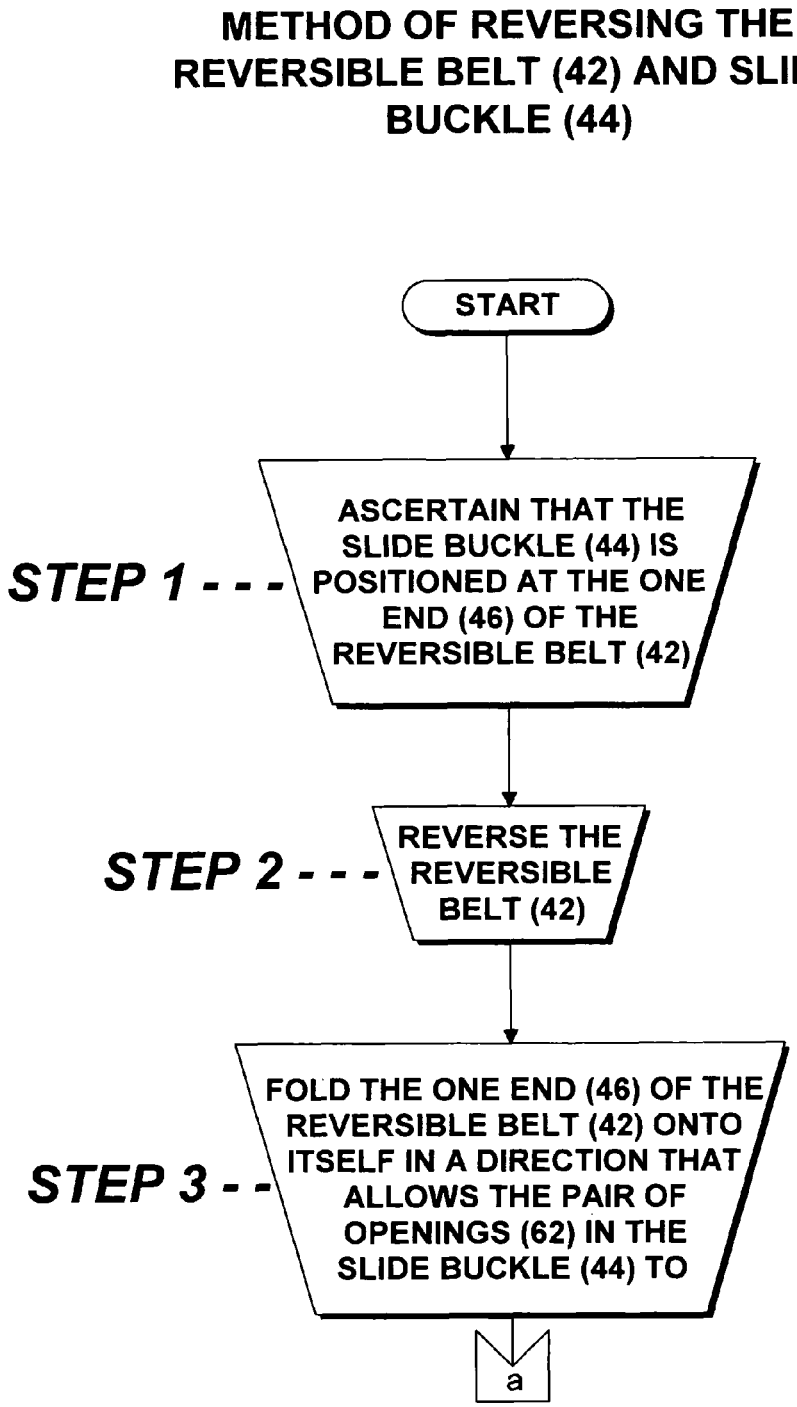
FIGS. 9A-9B are a flow chart of a second method of reversing the reversible belt having a slide buckle freely movable there along, retained on one end thereof without looping the one end thereof, and replaceable thereon via the other end thereof without compromising the structural integrity thereof of the present invention shown in FIGS. 3 and 4.
Figure 9B:
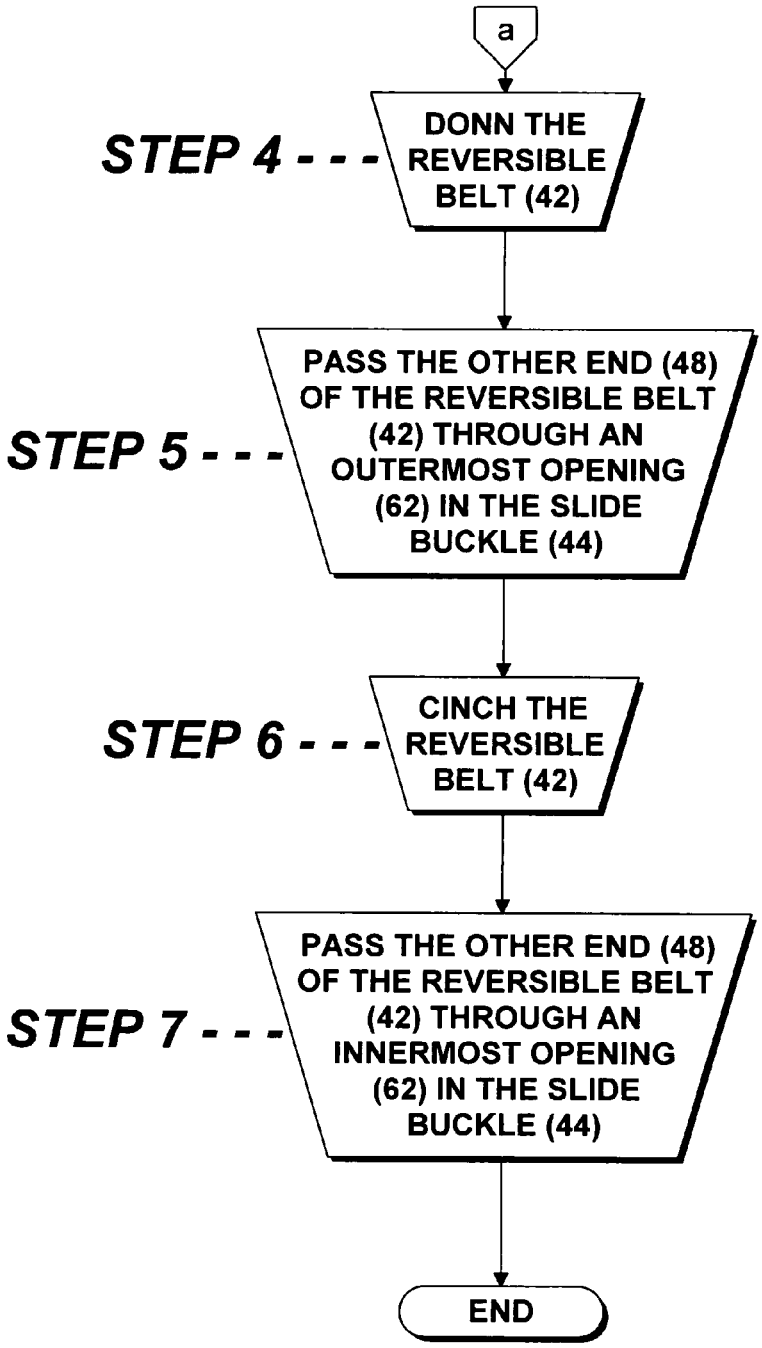
Figure 14:
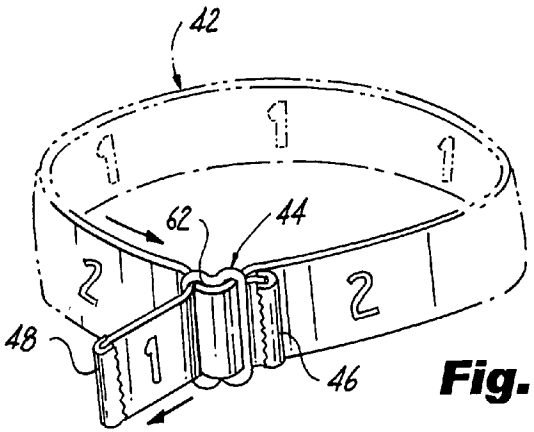
Figure 15:
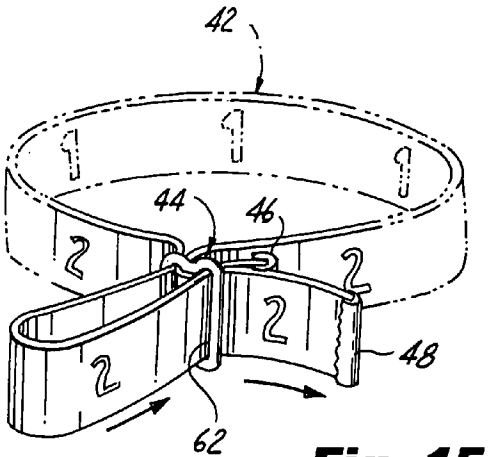

FIG. 14 is a diagrammatic perspective view of STEP 5 of the second method of reversing the reversible belt having a slide buckle freely movable there along, retained on one end thereof without looping the one end thereof, and replaceable thereon via the other end thereof without compromising the structural integrity thereof of the present invention shown in FIGS. 9A-9B; and FIG. 15 is a diagrammatic perspective view of STEP 7 of the second method of reversing the reversible belt having a slide buckle freely movable there along, retained on one end thereof without looping the one end thereof, and replaceable thereon via the other end thereof without compromising the structural integrity thereof of the present invention shown in FIGS. 9A-9B.

4. LIST OF REFERENCE NUMERALS UTILIZED IN THE DRAWING

A. Prior Art

20 prior art reversible belt
22 buckle
24 pair of ends of prior art reversible belt 20
26 one end of pair of ends 24 of prior art reversible belt 20
28 other end of pair of ends 24 of prior art reversible belt 20
30 loop of other end 28 of pair of ends 24 of prior art reversible belt 20

B. Present Invention

40 reversible belt having a slide buckle freely movable there along, retained on one end thereof without looping the one end thereof, and replaceable thereon via other end thereof without compromising structural integrity thereof of present invention

42 reversible belt

44 slide buckle

46 one end of reversible belt 42

48 other end of reversible belt 42

50 first belt/clench tip of one end 46 of reversible belt 42

52 second belt/clench tip of other end 48 of reversible belt 42

54 body of slide buckle 44

56 pair of outer limbs of body 54 of slide buckle 44

58 central limb of body 54 of slide buckle 44

60 two pair of one of bows and straights of body 54 of slide buckle 44

62 pair of openings in body 54 of slide buckle 44

5. DETAILED DESCRIPTION OF THE INVENTION

A. Apparatus

Figures 1, 2, 3, 4:
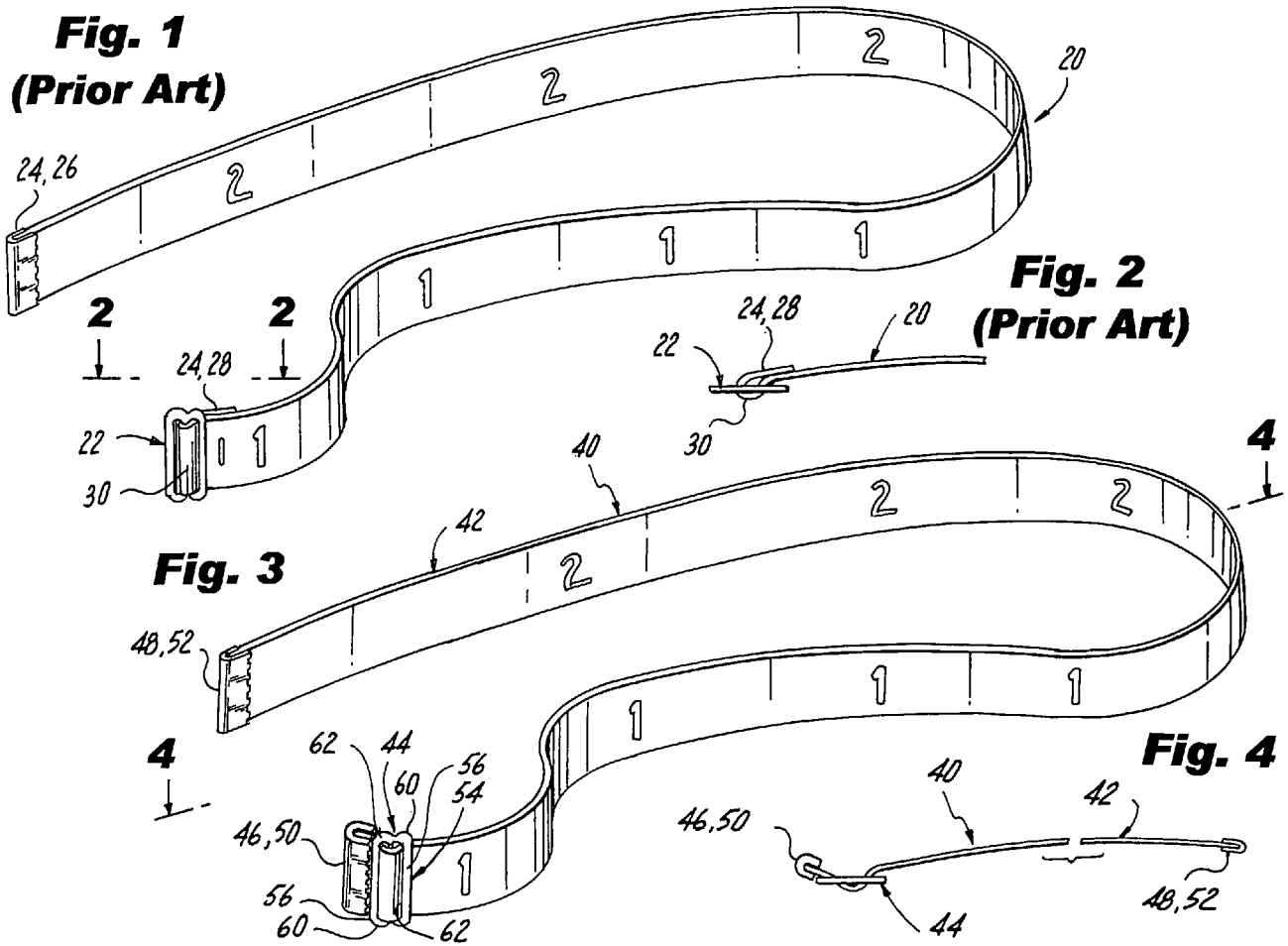
Fig. 1 (Prior Art)
Fig. 2 (Prior Art)
FIG. 1 is a diagrammatic perspective view of a typical prior art reversible belt with a buckle.
FIG. 2 is a diagrammatic top plan view of the area identified by ARROWS 2-2 in FIG. 1.
FIG. 3 is a diagrammatic perspective view of the reversible belt having a slide buckle freely movable there along, retained on one end thereof without looping the one end thereof, and replaceable thereon via the other end thereof without compromising the structural integrity thereof of the present invention.
FIG. 4 is a diagrammatic top plan view of the area identified by ARROWS 4-4 in FIG. 3.

Referring now to FIGS. 3 and 4, which are, respectively, a diagrammatic perspective view of the reversible belt having a slide buckle freely movable there along, retained on one end thereof without looping the one end thereof, and replaceable thereon via the other end thereof without compromising the structural integrity thereof of the present invention, and, a diagrammatic top plan view of the area identified by ARROWS 4-4 in FIG. 3, the reversible belt having a slide buckle freely movable there along, retained on one end thereof without looping the one end thereof, and replaceable thereon via the other end thereof without compromising the structural integrity thereof of the present invention is shown generally at 40.

It is to be understood that the reversible belt having a slide buckle freely movable there along, retained on one end thereof without looping the one end thereof, and replaceable thereon via the other end thereof without compromising the structural integrity thereof 40 can be used for belts, dog collars, arm bands, watch bands, and the like, i.e., it can be used for anything warranting the use of a band.

The reversible belt having a slide buckle freely movable there along, retained on one end thereof without looping the one end thereof, and replaceable thereon via the other end thereof without compromising the structural integrity thereof 40 comprises a reversible belt 42 and a slide buckle 44. The reversible belt 42 is slender, elongated, and has one end 46 and the other end 48. The slide buckle 44 is freely movable along the reversible belt 42, is retained on the one end 46 of the reversible belt 42 without looping the one end 46 of the reversible belt 42, and is replaceable on the reversible belt 42 via the other end 48 of the reversible belt 42 without compromising the structural integrity of the reversible belt 42.

The one end 46 of the reversible belt 42 is thick enough to prevent the slide buckle 44 from sliding there off so as to be retained thereon without looping the one end 46 of the reversible belt 42.

The other end 48 of the reversible belt 42 is thin enough to allow the slide buckle 44 to slide there off so as to be replaceable on the reversible belt 42 without compromising the structural integrity of the reversible belt 42 thereby allowing the slide buckle 44 to be slide there off, the reversible belt 42 reversed, and the slide buckle 44 slide back thereon so as to allow the reversible belt 42 to be reversible without looping of the one end 46 of the reversible belt 42 and without compromising the structural integrity of the reversible belt 42.

For example, the one end 46 of the reversible belt 42 can be finished off with a first belt/clench tip 50, while the other end 48 of the reversible belt 42 can be finished off with a second belt/clench tip 52. Typical first and second belt/clench tips 50, 52 are sold by Waterbury Manufacturing of Waterbury Conn.

The first belt/clench tip 50 can be used to cause the one end 46 of the reversible belt 42 to be thick enough to prevent the slide buckle 44 from sliding there off so as to be retained thereon without looping the one end 46 of the reversible belt 42.

The second belt/clench tip 52 can be used to cause the other end 48 of the reversible belt 42 to be thin enough to allow the slide buckle 44 to slide there off so as to be replaceable on the reversible belt 42 without compromising the structural integrity of the reversible belt 42 thereby allowing the slide buckle 44 to be slide there off, the reversible belt 42 reversed, and the slide buckle 44 slide back thereon so as to allow the reversible belt 42 to be reversible without looping of the one end 46 of the reversible belt 42 and without compromising the structural integrity of the reversible belt 42.

It is to be understood, however, that the first belt/clench tip 50 and the second belt/clench tip 52 are only examples and that any other way can be used to insure that the one end 46 of the reversible belt 42 and the other end 48 of the reversible belt 42 are of the proper dimension to fulfil their functions as discussed here throughout, for example, the one end 46 of the reversible belt 42 can be folded back onto itself and affixed thereto by, for example, gluing, sewing, and the like.

The slide buckle 44 is for example similar to that taught by U.S. Pat. No. 5,590,443 issued to Fildan on Jan. 7, 1997, which is incorporated herein by reference thereto, but with the exception of the lack of due to no need for the teeth.

For example, the slide buckle 44 comprises a body 54. The body 54 is one-piece, planar, and formed by a pair of outer limbs 56, a central limb 58, and two pair of one of bows and straights 60.

The pair of outer limbs 56 are substantially parallel to each other. The central limb 58 is substantially parallel to the outer limbs 56 and disposed between them. The two pair of one of bows and straights 60 connect each of the outer limbs 56 with the central limb 58. A respective outer limb 56, a respective pair of one of bows and straights 60, and the central limb 58 define a pair of openings 62 being elongated and formed on opposite sides of the central limb 58.

It is to be understood, however, that the slide buckle of Fildan is only an example, and that any other slide buckle can be used fulfilling its function as discussed here throughout.

B. Methods (1) First method.

Figure 5:
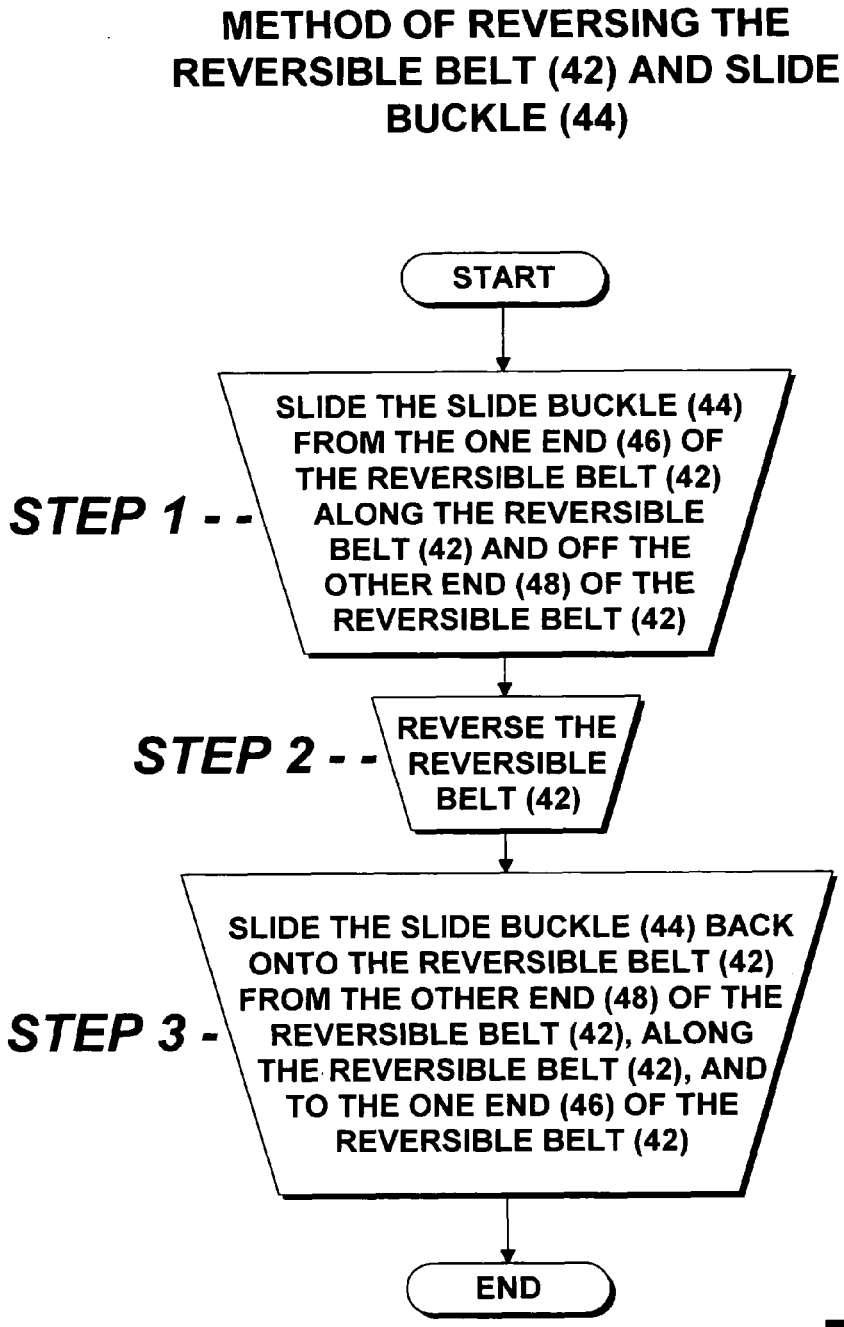
FIG. 5 is a flow chart of a first method of reversing the reversible belt having a slide buckle freely movable there along, retained on one end thereof without looping the one end thereof, and replaceable thereon via the other end thereof without compromising the structural integrity thereof of the present invention shown in FIGS. 3 and 4.

A first method of reversing the reversible belt 42 and slide buckle 44 can best be seen in FIGS. 5-8, which are, respectively, a flow chart of a first method of reversing the reversible belt having a slide buckle freely movable there along, retained on one end thereof without looping the one end thereof, and replaceable thereon via the other end thereof without compromising the structural integrity thereof of the present invention shown in FIGS. 3 and 4, a diagrammatic perspective view of STEP 1 of the first method of reversing the reversible belt having a slide buckle freely movable there along, retained on one end thereof without looping the one end thereof, and replaceable thereon via the other end thereof without compromising the structural integrity thereof of the present invention shown in FIG. 5, a diagrammatic perspective view of STEP 2 of the first method of reversing the reversible belt having a slide buckle freely movable there along, retained on one end thereof without looping the one end thereof, and replaceable thereon via the other end thereof without compromising the structural integrity thereof of the present invention shown in FIG. 5, and, a diagrammatic perspective view of STEP 3 of the first method of reversing the reversible belt having a slide buckle freely movable there along, retained on one end thereof without looping the one end thereof, and replaceable thereon via the other end thereof without compromising the structural integrity thereof of the present invention shown in FIG. 5, and as such will be discussed with reference thereto.

Figure 6:
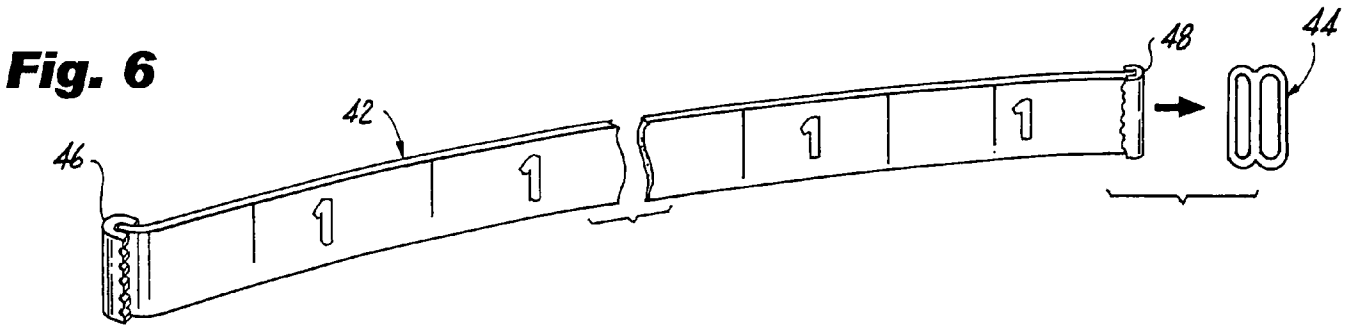
FIG. 6 is a diagrammatic perspective view of STEP 1 of the first method of reversing the reversible belt having a slide buckle freely movable there along, retained on one end thereof without looping the one end thereof, and replaceable thereon via the other end thereof without compromising the structural integrity thereof of the present invention shown in FIG. 5.

The first method of reversing the reversible belt 42 and slide buckle 44 comprises the following steps:

STEP 1: As shown in FIGS. 5 and 6, slide the slide buckle 44 from the one end 46 of the reversible belt 42 along the reversible belt 42 and off the other end 48 of the reversible belt 42.

Figure 7:
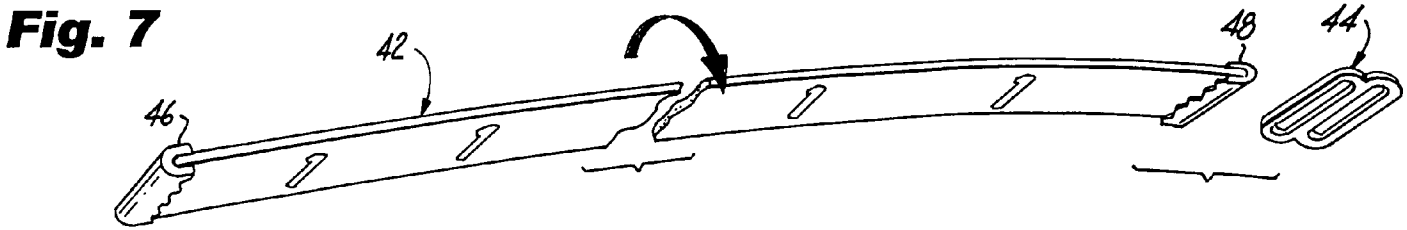
FIG. 7 is a diagrammatic perspective view of STEP 2 of the first method of reversing the reversible belt having a slide buckle freely movable there along, retained on one end thereof without looping the one end thereof, and replaceable thereon via the other end thereof without compromising the structural integrity thereof of the present invention shown in FIG. 5.

STEP 2: As shown in FIGS. 5 and 7, reverse the reversible belt 42.

Figure 8:
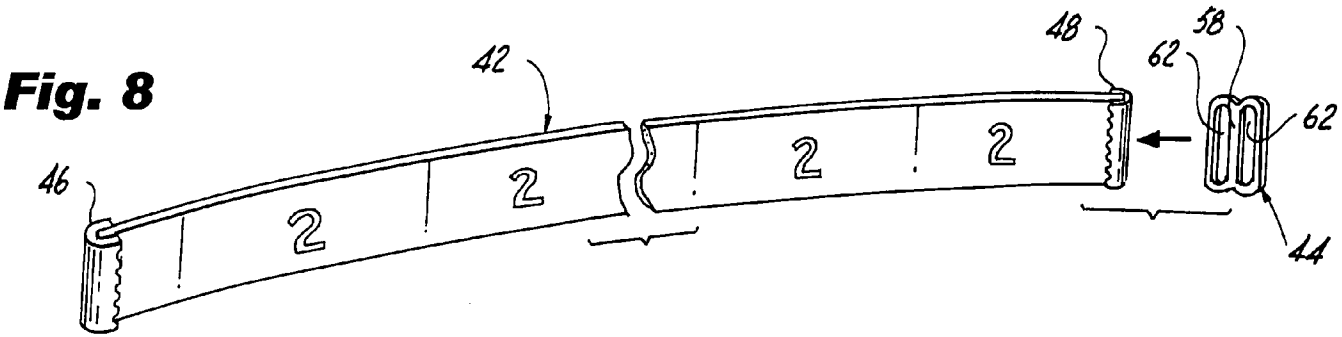
FIG. 8 is a diagrammatic perspective view of STEP 3 of the first method of reversing the reversible belt having a slide buckle freely movable there along, retained on one end thereof without looping the one end thereof, and replaceable thereon via the other end thereof without compromising the structural integrity thereof of the present invention shown in FIG. 5.

STEP 3: As shown in FIGS. 5 and 8, weave the other end 48 of the reversible belt 42 out through an adjacent opening 62 in the slide buckle 44, over the central limb 58 of the slide buckle 44, and in through the other opening 62 in the slide buckle 44, then slide the slide buckle 44 along the reversible belt 42 to the one end 46 of the reversible belt 42.

(2) Second Method.

A second method of reversing the reversible belt 42 and slide buckle 44 can best be seen in FIGS. 9A-9B and 10-15, which are, respectively, a flow chart of a second method of reversing the reversible belt having a slide buckle freely movable there along, retained on one end thereof without looping the one end thereof, and replaceable thereon via the other end thereof without compromising the structural integrity thereof of the present invention shown in FIGS. 3 and 4, a diagrammatic perspective view of STEP 1 of the second method of reversing the reversible belt having a slide buckle freely movable there along, retained on one end thereof without looping the one end thereof, and replaceable thereon via the other end thereof without compromising the structural integrity thereof of the present invention shown in FIGS. 9A-9B, diagrammatic perspective views of STEP 2 of the second method of reversing the reversible belt having a slide buckle freely movable there along, retained on one end thereof without looping the one end thereof, and replaceable thereon via the other end thereof without compromising the structural integrity thereof of the present invention shown in FIGS. 9A-9B, a diagrammatic perspective view of STEP 3 of the second method of reversing the reversible belt having a slide buckle freely movable there along, retained on one end thereof without looping the one end thereof, and replaceable thereon via the other end thereof without compromising the structural integrity thereof of the present invention shown in FIGS. 9A-9B, a diagrammatic perspective view of STEP 5 of the second method of reversing the reversible belt having a slide buckle freely movable there along, retained on one end thereof without looping the one end thereof, and replaceable thereon via the other end thereof without compromising the structural integrity thereof of the present invention shown in FIGS. 9A-9B, and a diagrammatic perspective view of STEP 7 of the second method of reversing the reversible belt having a slide buckle freely movable there along, retained on one end thereof without looping the one end thereof, and replaceable thereon via the other end thereof without compromising the structural integrity thereof of the present invention shown in FIGS. 9A-9B, and as such, will be discussed with reference thereto.

Figure 10:
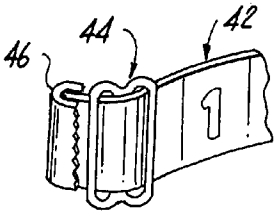
FIG. 10 is a diagrammatic perspective view of STEP 1 of the second method of reversing the reversible belt having a slide buckle freely movable there along, retained on one end thereof without looping the one end thereof, and replaceable thereon via the other end thereof without compromising the structural integrity thereof of the present invention shown in FIGS. 9A-9B.

The second method of reversing the reversible belt 42 and slide buckle 44 comprises the following steps:

STEP 1: As shown in FIGS. 9A and 10, ascertain that the slide buckle 44 is positioned at the one end 46 of the reversible belt 42.

Figure 12:
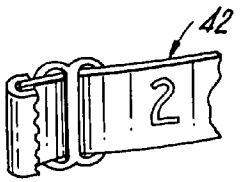
FIGS. 11 and 12 are diagrammatic perspective views of STEP 2 of the second method of reversing the reversible belt having a slide buckle freely movable there along, retained on one end thereof without looping the one end thereof, and replaceable thereon via the other end thereof without compromising the structural integrity thereof of the present invention shown in FIGS. 9A-9B.
Figure 11:
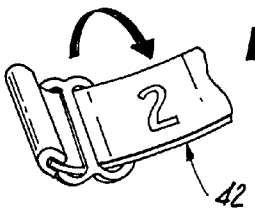

STEP 2: As shown in FIGS. 9A, 11, and 12, reverse the reversible belt 42.

Figure 13:
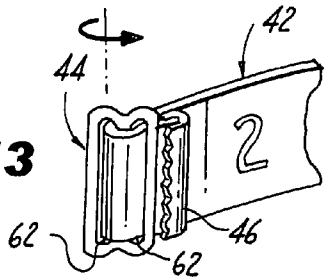
FIG. 13 is a diagrammatic perspective view of STEP 3 of the second method of reversing the reversible belt having a slide buckle freely movable there along, retained on one end thereof without looping the one end thereof, and replaceable thereon via the other end thereof without compromising the structural integrity thereof of the present invention shown in FIGS. 9A-9B.

STEP 3: As shown in FIGS. 9A and 13, fold the one end 46 of the reversible belt 42 onto itself in a direction allowing the pair of openings 62 in the slide buckle 44 to be accessible.

STEP 4: As shown in FIG. 9B, donn the reversible belt 42.

STEP 5: As shown in FIGS. 9B and 14, pass the other end 48 of the reversible belt 42 through an outermost opening 62 in the slide buckle 44.

STEP 6: As shown in FIG. 9B, cinch the reversible belt 42.

STEP 7: As shown in FIGS. 9B and 15, pass the other end 48 of the reversible belt 42 through an innermost opening 62 in the slide buckle 44.

It will be understood that each of the elements described above or two or more together may also find a useful application in other types of constructions differing from the types described above.

While the invention has been illustrated and described as embodied in a reversible belt having a slide buckle freely movable there along, retained on one end thereof without looping the one end thereof, and replaceable thereon via the other end thereof without compromising the structural integrity thereof, however, it is not limited to the details shown since it will be understood that various omissions, modifications, substitutions, and changes can be made by those skilled in the art without departing in any way from the spirit of the present invention.

Without further analysis the foregoing will so fully reveal the gist of the present invention that others can by applying current knowledge readily adapt it for various applications without omitting features that from the standpoint of prior art fairly constitute characteristics of the present invention.

The invention claimed is:

1. A garment belt, comprising:

a) a reversible belt having a one end and an other end; and b) a slide buckle;

wherein said reversible belt has a pair of ends;

wherein said slide buckle is freely movable along said reversible belt;

wherein said slide buckle is retained on said one end of said reversible belt without looping said one end of said reversible belt;

wherein said slide buckle is replaceable on said reversible belt via the said other end of said reversible belt without compromising structural integrity of said reversible belt;

wherein said one end of said reversible belt has a first belt/clench tip thereon;

wherein said other end of said reversible belt has a second belt/clench tip thereon; and wherein said first/clench belt tip causes said one end of said reversible belt to be thick enough to prevent said slide buckle from sliding there off so as to be retained thereon without looping said one end of said reversible belt.

2. The belt as defined in claim 1, wherein said other end of said reversible belt is thin enough to allow said slide buckle to slide there off so as to be replaceable on said reversible belt without compromising the structural integrity of said reversible belt, thereby allowing said slide buckle to be slid there off, said reversible belt reversed, and said slide buckle slid back thereon so as to allow said reversible belt to be reversible without looping of said one end of said reversible belt and without compromising the structural integrity of said reversible belt.

3. The belt as defined in claim 1, wherein said reversible belt is slender; and wherein said reversible belt is elongated.

4. The belt as defined in claim 1, wherein said one end of said reversible belt is folded back onto itself and affixed thereto causing said one end of said reversible belt to be thick enough to prevent said slide buckle from sliding there off so as to be retained thereon without looping said one end of said reversible belt.

5. The belt as defined in claim 1, wherein said second belt/clench tip causes said other end of said reversible belt to be thin enough to allow said slide buckle to slide there off so as to be replaceable on said reversible belt without compromising the structural integrity of said reversible belt, thereby allowing said slide buckle to be slid there off, said reversible belt reversed, and said slide buckle slid back thereon so as to allow said reversible belt to be reversible with looping of said one end of said reversible belt and without compromising the structural integrity of said reversible belt.

6. The belt as defined in claim 1, wherein said slide buckle comprises a body.

7. The belt as defined in claim 6, wherein said body of said slide buckle is one-piece; and wherein said body of said slide buckle is planar.

8. The belt as defined in claim 6, wherein said body of said slide buckle has a pair of outer limbs;

wherein said body of said slide buckle has a central limb; and wherein said body of said slide buckle has two pair of one of bows and straights.

9. The belt as defined in claim 8, wherein said central limb of said slide buckle is disposed between said pair of outer limps of said slide buckle;

wherein said two pair of one of bows and straights of said slide buckle connect each of said outer limbs of said slide buckle with said central limp of said slide buckle;

wherein a respective outer limb of said slide buckle, a respective pair of one of bows and straights of said slide buckle, and said central limb of said slide buckle define a pair of openings; and wherein said pair of openings in said slide buckle are on opposite sides of said central limb of said slide buckle.

10. The belt as defined in claim 8, wherein said pair of outer limbs of said slide buckle are substantially parallel to each other; and wherein said central limb of said slide buckle is substantially parallel to said pair of outer limbs of said slide buckle.

* * * * *